United States Patent [19]

Borst et al.

[11] Patent Number: 4,706,852

[45] Date of Patent: Nov. 17, 1987

[54] INLET SLEEVE FOR HOT-MELT DISPENSERS

[75] Inventors: Willi Borst, Florstadt; Reinhard Pfisterer, Kelkheim, both of Fed. Rep. of Germany

[73] Assignee: USM Corporation, Farmington, Conn.

[21] Appl. No.: 871,727

[22] Filed: Jun. 6, 1986

[30] Foreign Application Priority Data

Jun. 12, 1985 [GB] United Kingdom ..... 8514851

[51] Int. Cl.[4] ..... B67D 5/62

[52] U.S. Cl. ..... 222/146.2; 222/146.5; 219/230

[58] Field of Search ..... 222/146.2, 146.5, 391; 219/230, 421, 227

[56] References Cited

U.S. PATENT DOCUMENTS 4,552,287 11/1985 Dziki ..... 222/146.5

FOREIGN PATENT DOCUMENTS 0030893 6/1981 European Pat. Off. .
0118666 9/1984 European Pat. Off. .
1222258 2/1971 United Kingdom .
2032303 5/1980 United Kingdom .
2042092 9/1980 United Kingdom .
2048126 12/1980 United Kingdom .

*Primary Examiner*—Joseph J. Rolla
*Assistant Examiner*—Michael S. Huppert
*Attorney, Agent, or Firm*—Thomas S. Szatkowski

[57] ABSTRACT

A hot-melt dispenser or glue-gun is provided with a two-element sleeve at the inlet to the melt chamber, the elements being separated by a thermal barrier to reduce heat flow from that sleeve element in direct contact with the melt to the other sleeve element thereby inhibiting undue softening or even premature melting of the rod of thermoplastic composition held within the sleeve as it is fed to the melt.

1 Claim, 2 Drawing Figures

INLET SLEEVE FOR HOT-MELT DISPENSERS

TECHNICAL FIELD

Figure 1:
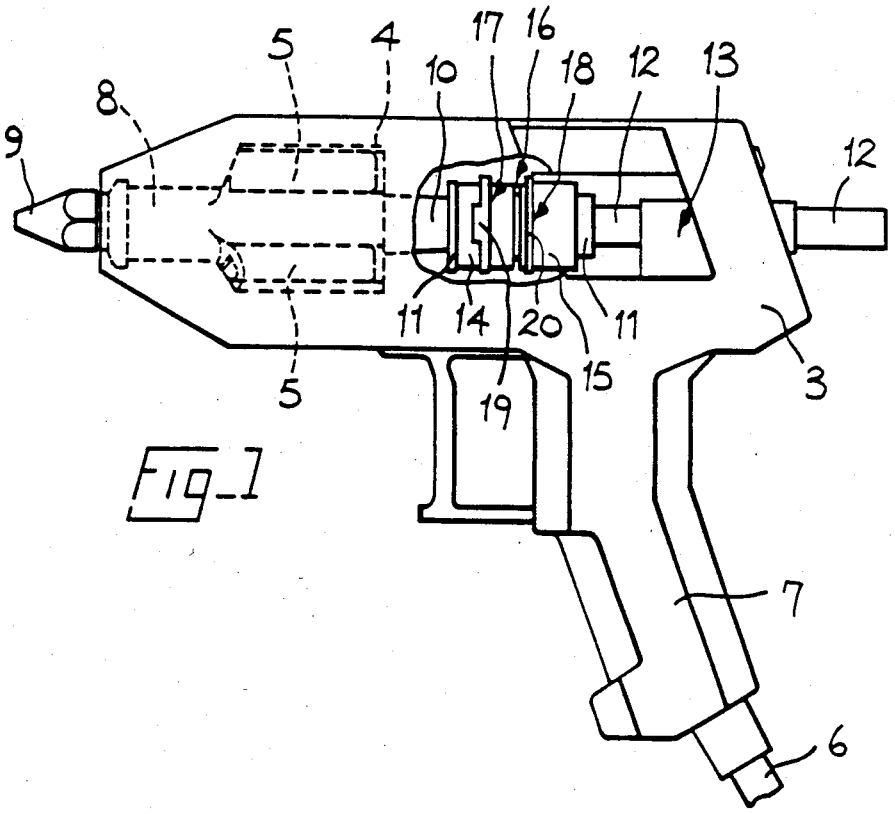

The present invention relates to hot-melt dispensers, generally known as glue-guns, and component parts thereof.

BACKGROUND ART

Glue-guns comprise apparatus for the melting, dispensing and application of thermoplastic material usually supplied in the form of a rod. Examples of apparatus of this kind manufactured and sold by the applicants are described in U.K. Pat. No. 1 402 648, EPA No. 017 0487 (from UK application No. 84 19 302) and EPA No. 017 0488 (from UK application No. 84 19 303).

Such apparatus may be described as having a melt body providing a melt chamber in which thermoplastic material is melted, an inlet for a rod of thermoplastic material and an outlet comprising an orifice for dispensing and applying melted material, and means for heating the melt body so that thermoplastic material fed as a rod into the melt chamber may be melted and then dispensed and applied in molten condition from the orifice. Such apparatus finds use in various fields of application, commonly in the form of applicators for hot-melt adhesives and sealants and especially in hot-melt glue-guns having provision for feeding a rod of adhesive material to the melt body.

The present invention is concerned with hot-melt guns for melting rods of thermoplastic material, and for dispensing and applying the resulting hot-melt compositions and is more particularly concerned with a hand-held glue-gun comprising improved feeding means adapted to feed hot-melt material in the form of a rod to the melt body.

Rod feeding means employed in hand-held glue-guns often includes a trigger and associated mechanism arranged to grip a rod of thermoplastic material to be fed, and to advance it towards the melt chamber. In most cases, an inlet sleeve e.g. of heat-resistant, usually resilient, material is provided at the entrance to the melt chamber which is intended to assist in guiding the rod into the melt chamber and also to grip the surface of the rod as it is fed into the melt chamber thus minimising flow-back of melted material from the melt chamber inlet. For example, patent specification GB Pat. No. 1 402 648 (Bostik) describes a hand-held hot-melt glue-gun having feeding means for feeding a rod of hot-melt material in solid form through such an inlet sleeve into a melt body.

Glue-guns with such sleeves have indeed become commonplace and are described in many patent specifications such as GB Pat. No. 2 048 126 (Hilti).

However, outflow of melted rod from the inlet of a melt chamber can increase adversely if the temperature of the sleeve, which is in direct contact with the melt, rises so that the rod is softened or even prematurely melted, thus allowing unwanted egress of melt between the rod and the sleeve.

Various attempts have been made to improve the performance of such sleeves. For example, in GB Pat. No. 2 032 303 (Hilti) an insulating ring is interposed between the sealing sleeve and the melt chamber. GB Pat. No. 1 222 258 (Daubert) proposes the use of an insulating liner and EP No. 30 893 (Soc. Fr. d'Agrafage) makes use of a bush of heat-resistant material. None of these references however, propose to insert a further thermal barrier within the sealing sleeve itself.

It is an object of the present invention to provide a hot-melt dispenser comprising a sleeve which inhibits heat distortion of a rod of thermoplastic material fed to the melt.

It is a further object of the present invention to provide a sleeve for the inlet of a hot-melt dispenser or glue-gun which inhibits heat distortion of a rod of thermoplastic material held within said sleeve.

BRIEF DISCLOSURE OF THE INVENTION

According to the present invention we provide a hot-melt dispenser of the kind hereinbefore described and having a sleeve of heat-resistant material at the inlet to the melt chamber of said dispenser wherein said sleeve is provided with a thermal barrier whereby the sleeve is divided into two separate elements.

Further according to the present invention, a hot-melt dispenser comprises a melt chamber in which thermoplastic material is melted, an inlet provided with a sleeve of heat-resistant material whereby a rod of thermoplastic material is guided into said melt chamber, an outlet comprising an orifice for dispensing and applying melted material, and means for heating the melt body so that thermoplastic material fed as rod into the melt chamber may be melted and then dispensed and applied in molten condition from said orifice, wherein said sleeve is provided with a thermal barrier whereby said sleeve is divided into two separate elements.

The thermal barrier is preferably an air gap maintained between the two elements of the sleeve. The thermal barrier inhibits the direct passage of heat from that element of the sleeve in contact with the molten material in the melt chamber to the other element of the sleeve to which the rod is fed, so that the rod is thus fed to the cooler part of the divided sleeve. The possibility of "flow-back" of melt from the melt chamber between the rod and the sleeve is considerably reduced by this break in the heat path from end to end of the sleeve, forming a thermal barrier to the passage of heat along the sleeve. It has been proposed in GB Pat. No. 2 042 092 (Hilti) to form a circumferential groove around the sealing sleeve in order to minimise such migration of heat along the sleeve, but here the heat path is merely constricted thereby and not fully broken by a thermal barrier as in the present invention.

DRAWINGS

Figure 2:
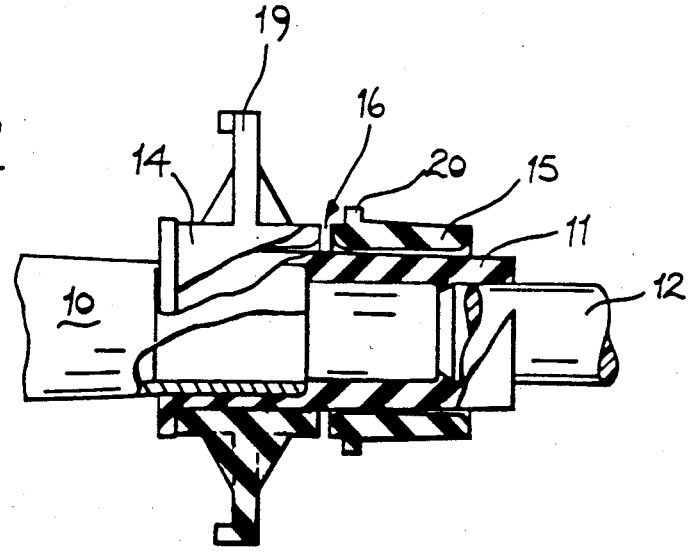

A preferred embodiment of the invention will now be described by way of example with reference to the accompanying drawings in which:

FIG. 1 is a schematic part-section of a hot-melt dispenser in the form of a glue-gun incorporating the invention, and FIG. 2 is a plan section on an enlarged scale of a detail of the glue-gun of FIG. 1.

The drawings illustrate a typical glue-gun which is a hot-melt dispenser made to dispense a hot-melt, for example of an adhesive or sealant, supplied to the gun in the form of a solid rod.

In the drawing, a casing 3 of glass-reinforced nylon houses a melt body 4 provided with PTC heaters 5 supplied with electricity through lead 6 passing through handle portion 7 of the casing 3. At one end of melt body 4 is an outlet 8 provided with a dispensing nozzle 9 and at the other end of the melt body 4 is melt body inlet 10. Melt body 4 is located in casing 3 by supports (not shown) formed in casing 3 so as to engage chosen parts of melt body 4, melt body inlet 10 and outlet 8. In operation, a rod 12 of solid e.g. adhesive material is pressed through a resilient silicon rubber tube 11, from melt body inlet 10 into melt body 4, by means of a trigger-operated feed mechanism indicated at 13. Resilient tube 11 is contained within inlet sleeve 14/15 located at the end of melt body inlet 10 and engages rod 12. This inlet sleeve is formed of silicon rubber in two elements 14, 15 separated by a gap 16 which acts as a thermal barrier; this arrangement necessitates two separate supports at 17, 18 for the supports 19, 20 respectively carrying the two elements 14, 15 of the sleeve.

EXPLANATION OF THE INVENTION

In operation, the trigger-operated feed mechanism presses rod 12 through sleeve 14/15 and melt body inlet 10 into melt body 4 where it is melted by heaters 5. The melted material of rod 12 is expelled in its molten state from outlet 8 and may be dispensed by nozzle 9. Heat from the molten material in melt body 4 passes through melt body inlet 10 to the sleeve and element 14 of the sleeve is thus rapidly heated up. However, the gap 16 acts as a thermal barrier to limit heat flow along the sleeve so that sleeve element 15 does not heat up as quickly as sleeve element 14 and so that rod 12 is not subjected to undue heating from sleeve element 15 which can cause softening or even premature melting of the material of rod 12. When rod 12 is formed of a so-called hot-melt adhesive, it is often known as a "glue-stick".

We claim:

1. In a hot melt dispenser comprising a melt body in which a rod of thermoplastic material is melted, an inlet to said melt body wherein said thermoplastic material is guided into said melt body, an outlet comprising an orifice for dispensing melted material, and means for heating the melt body so that said thermoplastic material fed as a rod into the melt body may be melted and then dispensed in a melted condition from said orifice, the improvement which comprises:

a sleeve of a heat-resistant silicon rubber material located at the inlet to the melt body, said sleeve comprising two elements separated by an air gap thermal barrier and a resilient silicon rubber tube located within said sleeve.

* * * * *